US011439863B2

(12) United States Patent
Pasterino et al.

(10) Patent No.: US 11,439,863 B2
(45) **Date of Patent: *Sep. 13, 2022**

(54) UPPER BODY EXERCISE DEVICE

(71) Applicant: Pvolve, LLC, New York, NY (US)

(72) Inventors: Stephen Pasterino, New York, NY (US); Stephanie Wineman, Birmingham, MI (US)

(73) Assignee: Pvolve, LLC, New York, NY (US)

( * ) Notice: Subject to any disclaimer, the term of this patent is extended or adjusted under 35 U.S.C. 154(b) by 211 days.

This patent is subject to a terminal disclaimer.

(21) Appl. No.: 16/557,331

(22) Filed: Aug. 30, 2019

(65) Prior Publication Data

US 2020/0108288 A1 Apr. 9, 2020

Related U.S. Application Data

(63) Continuation-in-part of application No. 16/153,454, filed on Oct. 5, 2018, now Pat. No. 10,398,924.

(51) Int. Cl.
*A63B 21/00* (2006.01)
*A63B 21/055* (2006.01)

(52) U.S. Cl.
CPC .... *A63B 21/4019* (2015.10); *A63B 21/00043* (2013.01); *A63B 21/0552* (2013.01); *A63B 21/4025* (2015.10)

(58) Field of Classification Search
CPC ..... A63B 21/04–0407; A63B 21/4025; A63B 21/4035
See application file for complete search history.

(56) References Cited

U.S. PATENT DOCUMENTS

| | | | |
|---|---|---|---|
| 4,881,275 | A | 11/1989 | Cazares et al. |
| 5,306,222 | A | 4/1994 | Wilkinson |
| 5,829,058 | A | 11/1998 | Dicker et al. |
| 6,099,446 | A | 8/2000 | Johnson et al. |
| 6,176,816 | B1 | 1/2001 | Dicker et al. |
| 6,238,324 | B1 | 5/2001 | MacMillan |
| 7,134,968 | B1 | 11/2006 | Pryor |

(Continued)

OTHER PUBLICATIONS

Powerpunchgloves, "Using Resistance Bands with Power Punch Gloves", uploaded to YouTube on Jun. 4, 2010, https://www.youtube.com/watch?v=CFI_9oBkcT8, 16 sheets of screenshots.

(Continued)

*Primary Examiner* — Nyca T Nguyen
(74) *Attorney, Agent, or Firm* — Foley & Lardner LLP

(57) ABSTRACT

An exercise device includes a first set of one or more finger loops coupled to a first palm portion having a first surface and a second surface, and configured to be worn on a first hand of a user. The exercise device also includes a second set of one or more finger loops coupled to a second palm portion having a first surface and a second surface and configured to be worn on a second hand of the user. The exercise device also includes a first connecter coupled to and located on the second surface of the first palm portion and a second connecter coupled to and located on the second surface of the second palm portion. The first connector and the second connector are secured to opposite ends of a tension member linking the first palm portion and the second palm portion.

20 Claims, 12 Drawing Sheets

(56) References Cited

U.S. PATENT DOCUMENTS

| | | | | |
|---|---|---|---|---|
| 8,403,818 | B1 | 3/2013 | Wilkinson et al. | |
| 8,430,799 | B2 | 4/2013 | Tussy | |
| 8,876,639 | B2 | 11/2014 | Ruvoli | |
| 9,061,173 | B1 | 6/2015 | Felkel | |
| 9,248,331 | B1 * | 2/2016 | Collier | A63B 21/0555 |
| 9,452,311 | B1 | 9/2016 | Kaczmarek | |
| 2005/0026113 | A1 | 2/2005 | Chen et al. | |
| 2006/0052223 | A1 | 3/2006 | Terry | |
| 2006/0073954 | A1 | 4/2006 | Block et al. | |
| 2007/0135279 | A1 | 6/2007 | Purdy et al. | |
| 2007/0207905 | A1 | 9/2007 | Winston | |
| 2009/0098945 | A1 | 4/2009 | George | |
| 2010/0016132 | A1 | 1/2010 | Flynn | |
| 2010/0126902 | A1 * | 5/2010 | Garza, Jr. | A63B 23/12 206/579 |
| 2010/0222189 | A1 | 9/2010 | Washington | |
| 2010/0257651 | A1 | 10/2010 | Anderson et al. | |
| 2011/0224055 | A1 * | 9/2011 | Kassel | A63B 21/4019 482/121 |
| 2011/0301001 | A1 | 12/2011 | Hopper | |
| 2011/0312476 | A1 * | 12/2011 | Cappellano | A63B 21/4035 482/126 |
| 2012/0017351 | A1 | 1/2012 | Mccrane | |
| 2012/0157273 | A1 | 6/2012 | Tussy | |
| 2013/0333097 | A1 | 12/2013 | Cranke et al. | |
| 2014/0373244 | A1 * | 12/2014 | Jhaveri | A63B 71/14 2/20 |
| 2015/0005141 | A1 | 1/2015 | Krahling et al. | |
| 2015/0057136 | A1 | 2/2015 | Dorsey et al. | |
| 2015/0065317 | A1 | 3/2015 | Washington | |
| 2015/0141215 | A1 * | 5/2015 | Williams | A63B 21/4035 482/124 |
| 2015/0297938 | A1 | 10/2015 | Dyer | |

OTHER PUBLICATIONS

International Search Report and Written Opinion on International Application No. PCT/US2020/048394, dated Nov. 20, 2020, 14 pages.

* cited by examiner

UPPER BODY EXERCISE DEVICE

CROSS-REFERENCE TO RELATED PATENT APPLICATIONS

This application is a continuation-in-part of U.S. patent application Ser. No. 16/153,454 filed Oct. 5, 2018, which is hereby incorporated by reference in its entirety.

BACKGROUND

The present disclosure relates generally to exercise devices for exercising the upper body of a user. More particularly, the present disclosure relates to an exercise device in which a user can use resistance training to exercise different sets of upper body muscles by applying tensile forces to the exercise device. This type of training may allow the user to strengthen and tone his or her upper body without building bulky muscles by performing multiple exercises at once.

Traditional upper body workout equipment is either intended to increase the size or "bulkiness" of upper body muscles of the user or is difficult for the user to properly use to obtain the results that the user desires. For example, to obtain certain results, a user that trains using free weights must be familiar with proper weight-training techniques to target specific muscles or muscle areas and further be knowledgeable of the proper size of weights to use. Using improper techniques and equipment can result in injury or other unintended results, such as unintentionally increasing the size of certain muscles. Another disadvantage of traditional upper body workout equipment is that it only enables a user to perform a single exercise at a time because the user's hands are required to be engaged with the equipment.

SUMMARY

One embodiment relates to an exercise device that includes a first set of one or more finger loops having a first palm portion coupled to a first surface and a second surface opposite the first surface. The first set of one or more finger loops are configured to be worn on a first hand of a user such that the first surface of the first palm portion interfaces with a palm of the first hand. The exercise device also includes a second set of one or more finger loops coupled to a second palm portion having a first surface and a second surface opposite the first surface. The second set of one or more finger loops are configured to be worn on a second hand of the user such that the first surface of the second palm portion interfaces with a palm of the second hand. The exercise device also includes a first connecter coupled to and located on the second surface of the first palm portion and a second connecter coupled to and located on the second surface of the second palm portion. The first connector and the second connector are secured to opposite ends of a tension member linking the first palm portion and the second palm portion.

Another embodiment relates to an exercise device that includes a first set of one or more finger loops coupled to a first palm portion having a first surface and a second surface opposite the first surface. The first set of one or more finger loops are configured to be worn on a first hand of a user such that the first surface of the first palm portion interfaces with a palm of the first hand. The exercise device includes a second set of one or more finger loops coupled to a second palm portion having a first surface and a second surface opposite the first surface. The second set of one or more finger loops are configured to be worn on a second hand of the user such that the first surface of the second palm portion interfaces with a palm of the second hand. The exercise device also includes a first connecter coupled to and located on the second surface of the first palm portion and a second connecter coupled to and located on the second surface of the second palm portion. Each of the connectors are secured to opposite ends of a tension member linking the first palm portion and the second palm portion. Each of the connectors include a looped structure and a grommet configured to reinforce a portion of the connector that interfaces with the tension member.

Another embodiment relates to an exercise device that includes a first set of one or more finger loops coupled to a first palm portion having a first surface and a second surface opposite the first surface. The first set of one or more finger loops are configured to be worn on a first hand of a user such that the first surface of the first palm portion interfaces with a palm of the first hand. The exercise device includes a second set of one or more finger loops coupled to a second palm portion having a first surface and a second surface opposite the first surface. The second set of one or more finger loops are configured to be worn on a second hand of the user such that the first surface of the second palm portion interfaces with a palm of the second hand. The exercise device also includes a first connecter coupled to and located on the second surface of the first palm portion and a second connecter coupled to and located on the second surface of the second palm portion. Each of the connectors comprise a looped structure that is configured to releasably couple with a tension member such that the tension member is interchangeable with another tension member. Each of the connectors are configured to rotate about the second surfaces of the palm portions, and move laterally to enable at least a portion of the connector to lay flat against the second surface of its corresponding palm portion.

This summary is illustrative only and is not intended to be in any way limiting. Other aspects, inventive features, and advantages of the devices or processes described herein will become apparent in the detailed description set forth herein, taken in conjunction with the accompanying figures, wherein like reference numerals refer to like elements.

DETAILED DESCRIPTION

Before turning to the figures, which illustrate certain exemplary embodiments in detail, it should be understood that the present disclosure is not limited to the details or methodology set forth in the description or illustrated in the figures. It should also be understood that the terminology used herein is for the purpose of description only and should not be regarded as limiting.

Referring generally to the figures, an exercise device is shown accordingly to exemplary embodiments. The exercise device can be used by a user to exercise an upper body of the user. The exercise device includes two gloves attached together by a tension member, which advantageously enable the user to retain freedom to rotate and position his or her hands without the tension member obstructing the movement. The user may rotate and position his or her hands to target specific muscles or muscle groups. The exercise device also advantageously enables the user to maintain a constant tension in the tension member during an exercise.

Figure 1:
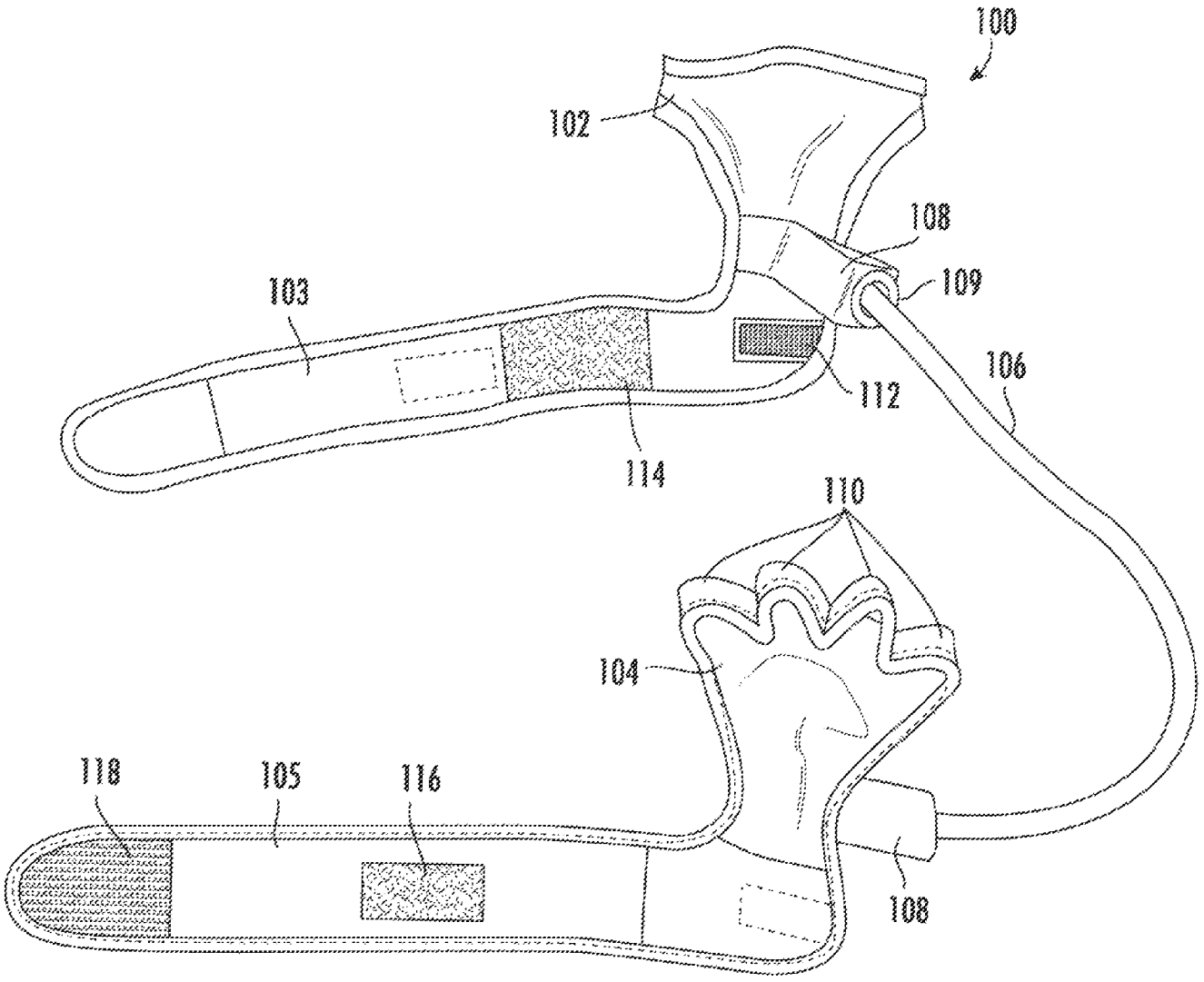
FIG. 1 is an illustration of an exercise device, according to an exemplary embodiment.
Figure 2:
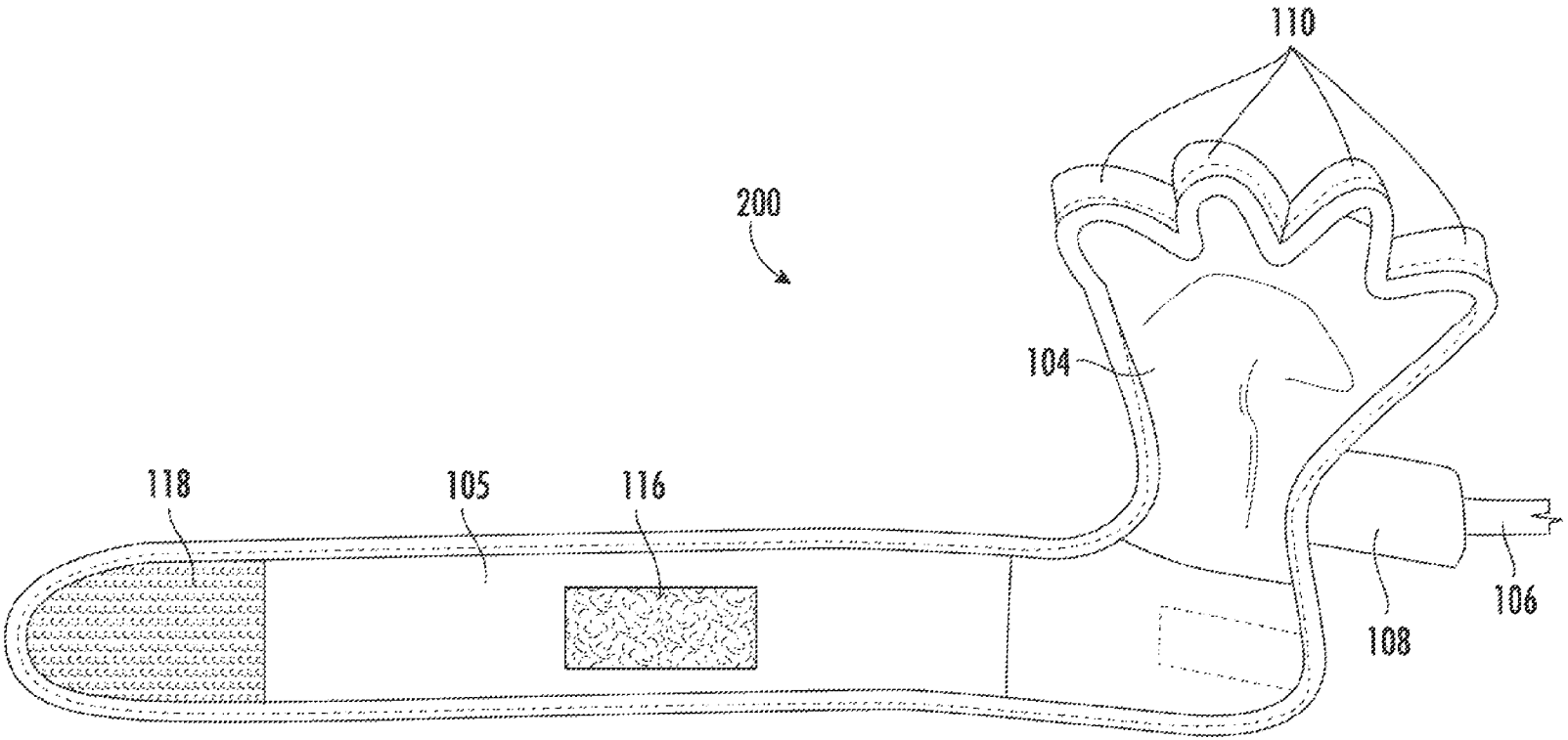
FIG. 2 is a close-up view of a right-hand portion of the exercise device of FIG. 1.
Figure 3:
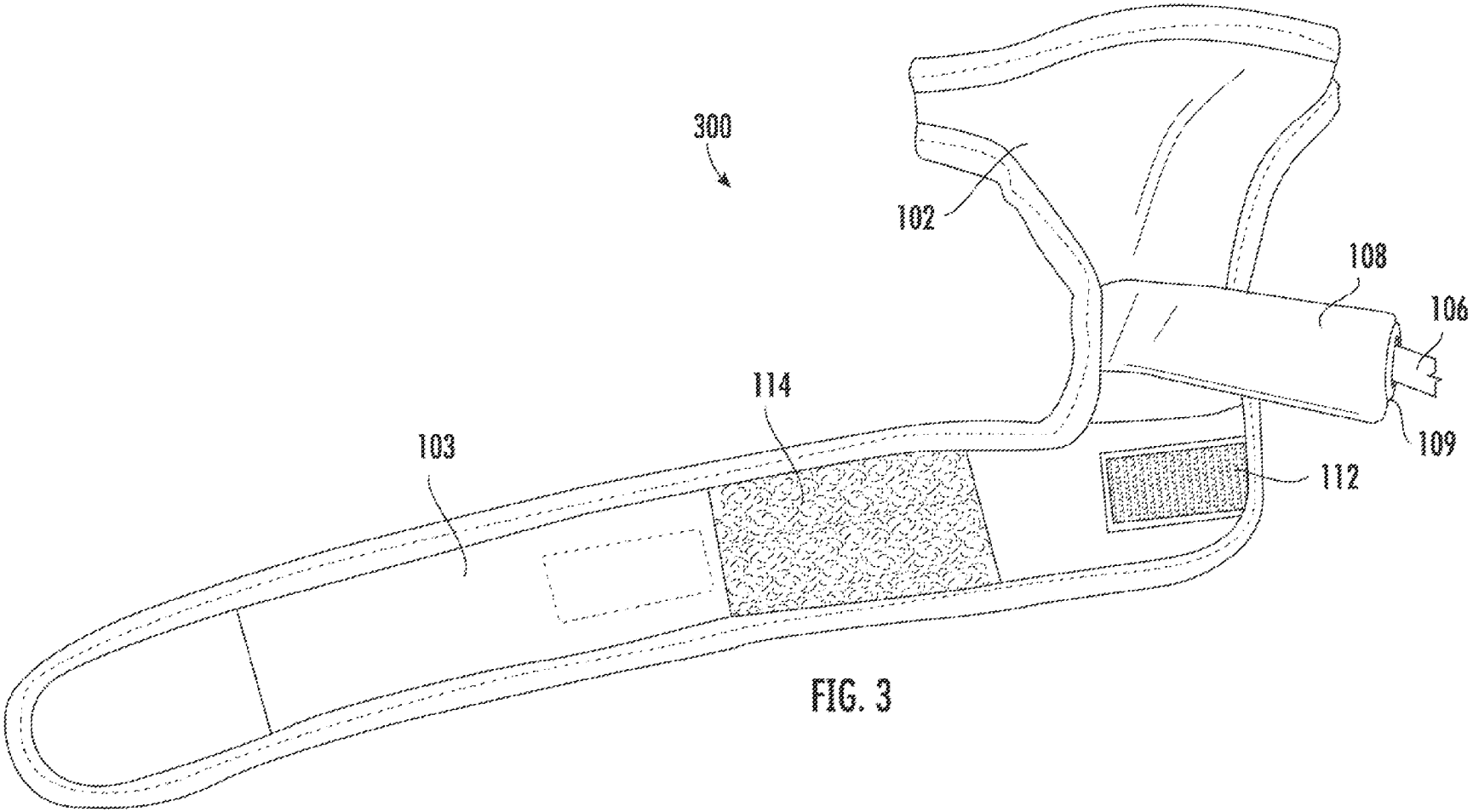
FIG. 3 is a close-up view of a left-hand portion of the exercise device of FIG. 1.

Referring now to FIGS. 1-3, illustrations of an exercise device 100 are shown, according to some embodiments. FIG. 1 shows an overall view of the exercise device 100. FIGS. 2-3 show close-up views of a right-hand portion 200 of the exercise device 100 and a left-hand portion 300 of the exercise device 100, respectively. The exercise device 100 is shown to include a left-hand glove 102 and a right-hand glove 104. The left-hand glove 102 has a left-wrist strap 103 and finger loops 110. The right-hand glove 104 has a right-wrist strap 105 and finger loops 110. The left-wrist strap 103 and the right-wrist strap 105 each include fasteners 112, 114, 116, and 118.

The left-hand glove 102 is attached to the right-hand glove 104 via a tension member 106. The tension member is secured to the left-hand glove 102 and the right-hand glove 104 at opposite ends via connectors 108 located on the bottom of the left-hand glove 102 and the bottom of the right-hand glove 104. The connectors 108 may include grommets 109 to route the tension member 106 through and reinforce a portion of the connector 108 that interfaces with the tension member 106 (e.g., by preventing the entirety of the tension member 106 from being pulled through). In some embodiments, the materials of exercise device 100 may include nylon, elastic, fabric, rubber, plastic, metal, etc., and any combination thereof. It will be appreciated that the exercise device 100 can be made of any suitable material.

The exercise device 100 may be worn by a user on his or her hands. The user can put on the left-hand glove 102 by placing his or her palm on the same surface of left-hand glove 102 on which the finger loops 110 are attached, hereby referred to as the top of the left-hand glove 102, and by inserting his or her fingers into the finger loops 110 located on the top of the left-hand glove 102.

To secure the left-hand glove 102 in place on the left-hand of the user, the user may attach the left-wrist strap 103 to a left wrist of the user. For example, the left-wrist strap 103 can wrap tightly around the left wrist of the user to prevent the left-hand glove 102 from moving or rotating during a workout. The left-wrist strap 103 can be wrapped around the left wrist of the user in such a way that allows for the fastener 116 to attach to fastener 112 and for the fastener 118 to attach to fastener 116. In various embodiments, the fasteners 112, 114, 116, and 118 may be hook-and-loop fasteners, snap fasteners, buckle fasteners, or any other appropriate fastener that enables the user to selectively secure the gloves to the appropriate hand of the user.

The user can put on the right-hand glove 104 by placing his or her palm on the same surface of right-hand glove 104 on which the finger loops 110 are attached, hereby referred to as the top of the right-hand glove 104, and by inserting his or her fingers into the finger loops 110 located on the top of the right-hand glove 104.

To secure the right-hand glove 104 in place on the right-hand of the user, the user may attach the right-wrist strap 105 to a right wrist of the user. For example, the right-wrist strap 105 can wrap tightly around the right wrist of the user to prevent the right-hand glove 104 from moving or rotating during a workout. The right-wrist strap 105 can be wrapped around the right wrist of the user in such a way that allows for the fastener 116 to attach to the fastener 112 and for the fastener 118 to attach to the fastener 116. In various embodiments, the fasteners 112, 114, 116, and 118 may be hook-and-loop fasteners, snap fasteners, buckle fasteners, or any other appropriate fastener that enables the user to selectively secure the gloves to the appropriate hand of the user.

The right-hand glove 104 and the left hand glove 102 may comprise pads to provide additional comfort for the user. For example, the finger loops 110 may include a padding such that the padding contacts the fingers and hands of the user when exercises are performed using the exercise device 100. Additionally, other portions of the right-hand glove 104 and the left-hand glove 102 may comprise pads, for example the portion of the gloves configured to interface with and contact the palms of the user. For example, a user may be performing an exercise in which one hand of the user is placed on the ground to support at least a portion of the user. A padded portion of the glove on the hand of the user placed on the ground may provide the user cushion from the ground and ultimately facilitate a more comfortable exercise experience for the user.

The right-wrist strap 105 and the left-wrist strap 103 can be configured to accommodate adjustable and/or incremental weights, according to some embodiments. For example, the right-wrist strap 105 and the left-wrist strap 103 may include pockets (e.g., pockets sewn to the straps) that allow a user to insert one or more weights into said pockets. The pockets may also include a means of securing any such weights within the pockets, such as elastic, or loop and hook fasteners configured to close a flap over the pockets. For example, a user may wish to add additional resistance to an exercise than that offered by the tension member 106. Accordingly, the user may insert incremental and/or adjustable weights into pockets of the right-wrist strap 105 and/or the left-wrist strap 103. Incremental and/or adjustable weights added by the user may include metal weights, weights comprising containers defining a volume that may be filled with sand, water, or other substances, as well as other possible varieties of weights. In some embodiments, adjustable or incremental weights may be added to the right-wrist strap 105 and/or the left-wrist strap 103 through other means, for example an additional component that may couple to the right-wrist strap 105 and/or the left-wrist strap 103 to allow for a weight (e.g., a small dumbbell) to be secured between the layers of the right-wrist strap 105 and/or the left-wrist strap 103 when secured and worn by a user.

Still referring to FIGS. 1-3, the steps for putting on the exercise device 100 may be completed by the user in any appropriate order or any combination thereof described herein. For example, the user may put on the right-hand portion 200 of the exercise device 100 before, after, or at the same time as the left-hand portion 300 of the exercise device 100. The user may wrap either the left-wrist strap 103 or the right-wrist strap 105 around the left wrist or right wrist, respectively, before or after the user puts on the left-hand glove 102 or the right-hand glove 104 to the left hand or right hand, respectively. The user may wrap both the left-wrist strap 103 around the left wrist and the right-wrist strap 105 around the right wrist before or after the user puts on the left-hand glove 102 to the left hand or the right-hand glove 104 to the right hand.

Figure 4:
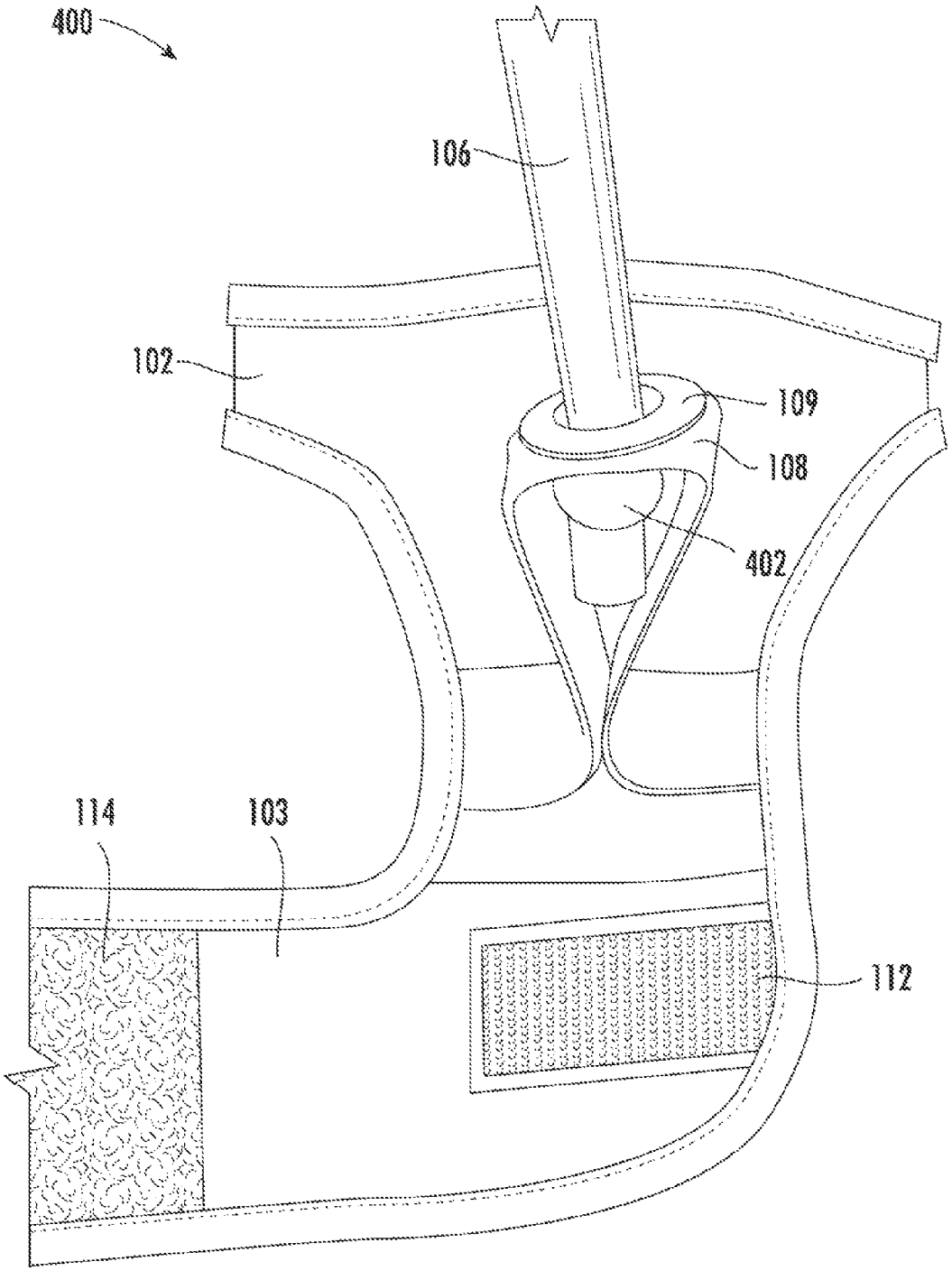
FIGS. 4-6 are close-up views of a portion the of the exercise device of FIG. 1 that connects the right-hand portion of FIG. 2 and the left-hand portion of FIG. 3.
Figure 5:
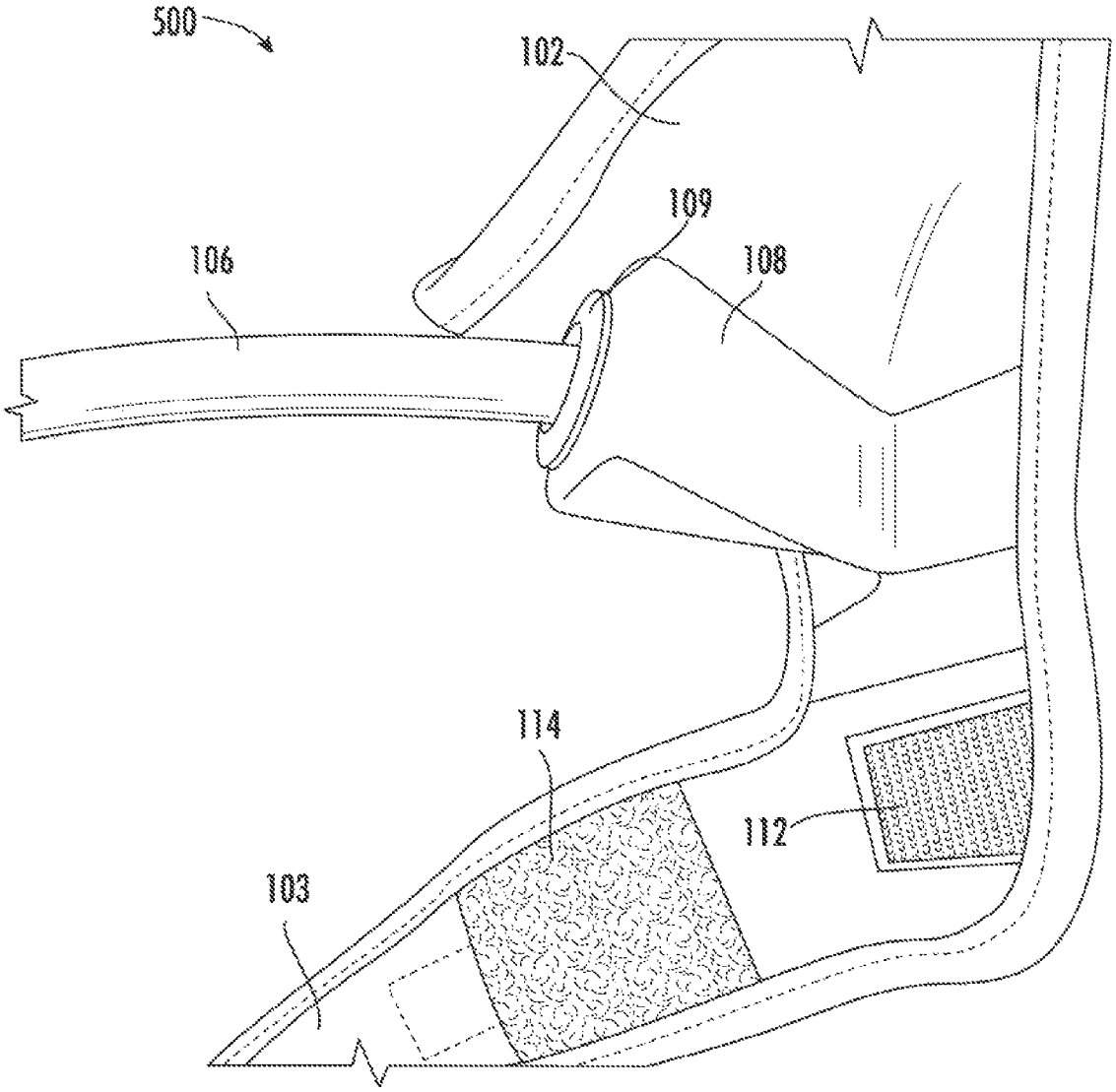
Figure 6:
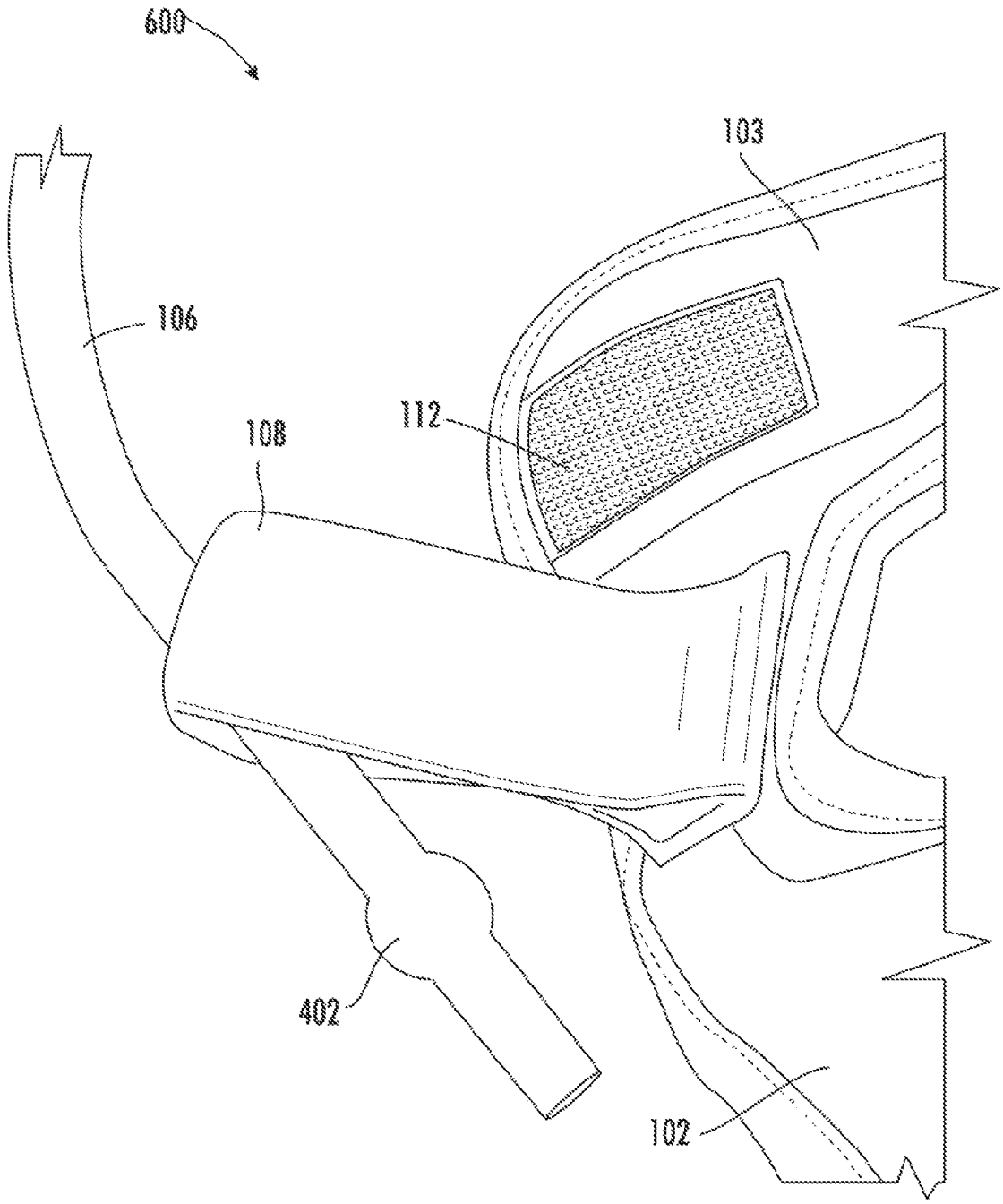

Referring now to FIGS. 4-6, close-up views 400, 500, and 600 of a portion the of the exercise device 100 that connects the right-hand portion 200 and the left-hand portion 300 of the exercise device 100 are shown, according to some embodiments. The tension member 106 is routed through the grommets 109 on each of the connectors 108. A retaining ball 402 is secured into both ends of the tension member 106 to secure the tension member 106 to the connectors 108 (e.g., by preventing the retaining ball 402 from being pulled back through the grommet 109). For example, the inner diameter of the grommet 109 may be less than the outer diameter of the retaining ball 402 to prevent the tension member 106 from disengaging with the connector 108. The retaining ball 402 may be friction fit within the tension member 106, secured with adhesive, or secured by any other appropriate means. In some embodiments, the retaining ball 402 is not used, and the tension member 106 is instead deformed at both ends to prevent the tension member 106 from being disengaged with the connectors 108.

The connectors 108 are located on the bottom of both the left-hand glove 102 and the right-hand glove 104. The locations of the connectors 108 positions the tensile force from the tension member 106 onto the palms of the user. This can be important for engaging certain muscle groups during exercises, such as the exercises described with reference to FIGS. 9-11. The tension member 106 is sized to allow for constant tension between the right-hand portion 200 and the left-hand portion 300 during an exercise. The tension member 106 may impose a tensile force when the right-hand portion 200 and the left-hand portion 300 of the exercise device 100 are positioned at a minimum distance from each other. The minimum distance or tensile strength may vary by exercise, as to impose more or less of a tensile force. For example, the tension member 106 may have a tensile force of up to 8 pounds when the user pulls the tension member 106 to a length that is 2.5 times longer than the original length (e.g., a length of the tension member 106 before the user applies a tensile force on the tension member 106, a length of the tension member 106 when relaxed) of the tension member 106. In some embodiments, the original length of the tension member 106 may be between 10 inches and 18 inches between the opposite ends of the tension member 106, or the tension member 106 may be any other appropriate length.

The location of the connectors 108 may allow the user to retain freedom to rotate and position his or her hands without the tension member 106 obstructing the movement. The user may rotate or position his or her hands to engage different muscle groups during exercises. For example, if the user rotates either or both of his or her left hand and right hand during and exercise, the connectors 108 are able to rotate in the opposite direction of the hand movement. This may prevent the tension member 106 from wrapping itself around the hands of the user.

The user may grasp the connectors 108 or any other object with his or her hands during an exercise while wearing the exercise device 100 without the tensile member 106 or the connectors 108 interfering. The connectors 108 can move laterally in a way that allows at least a portion of the connectors 108 to lay flat against the second surfaces of the gloves. For example, the user may be able to place both palms flat on the ground (e.g., to do a pushup) while wearing the exercise device 100 or may comfortably grip an object with the palms of his or her hands without the connectors 108 interfering. The connectors 108 can be secured or held in place in the palms by the user positioning his or her thumbs over the connectors 108 to hold the connectors 108 in place against the second surfaces of the gloves.

Figure 7:
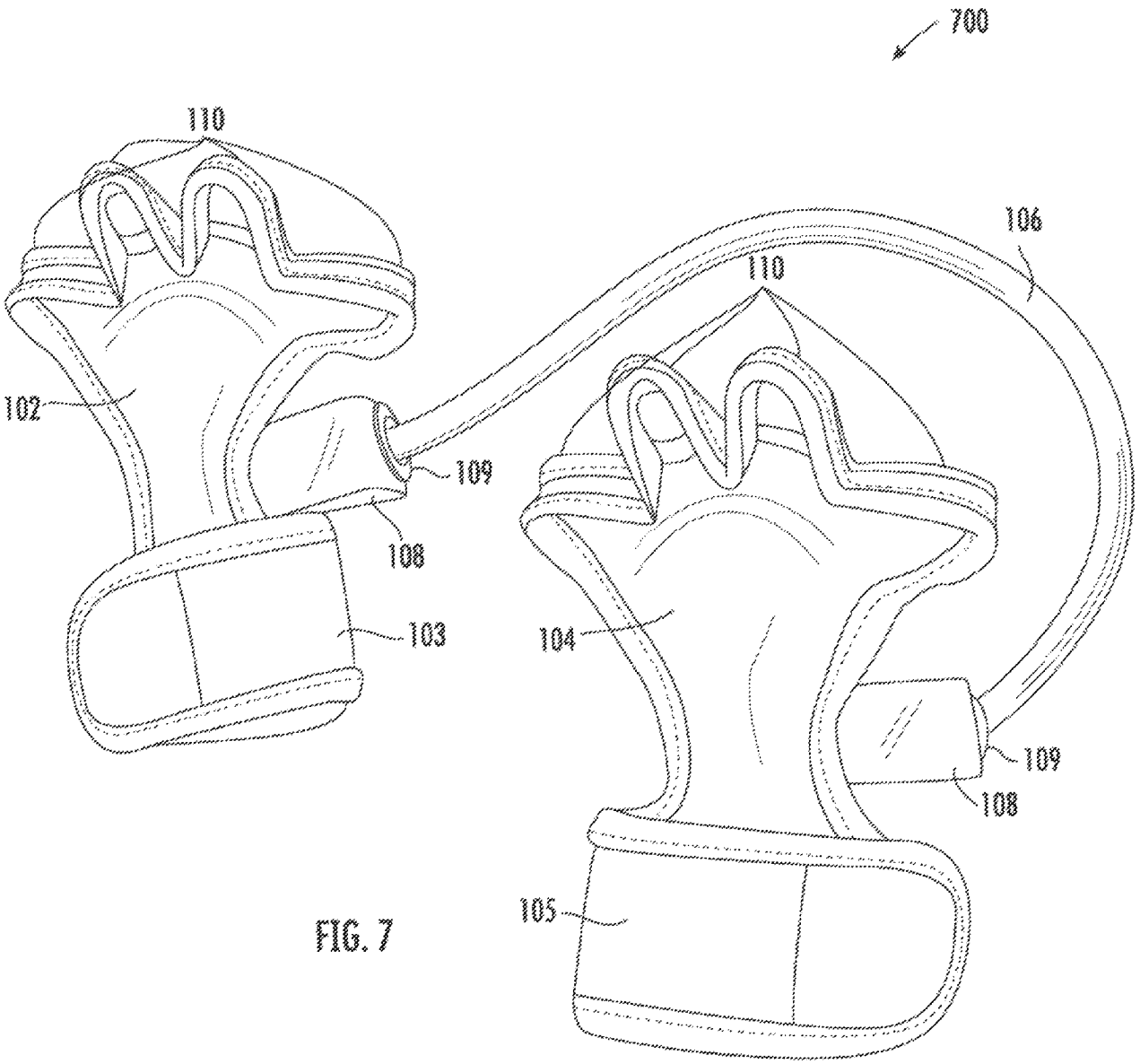
FIGS. 7-8 are illustrations of various views of the exercise device of FIG. 1.
Figure 8:
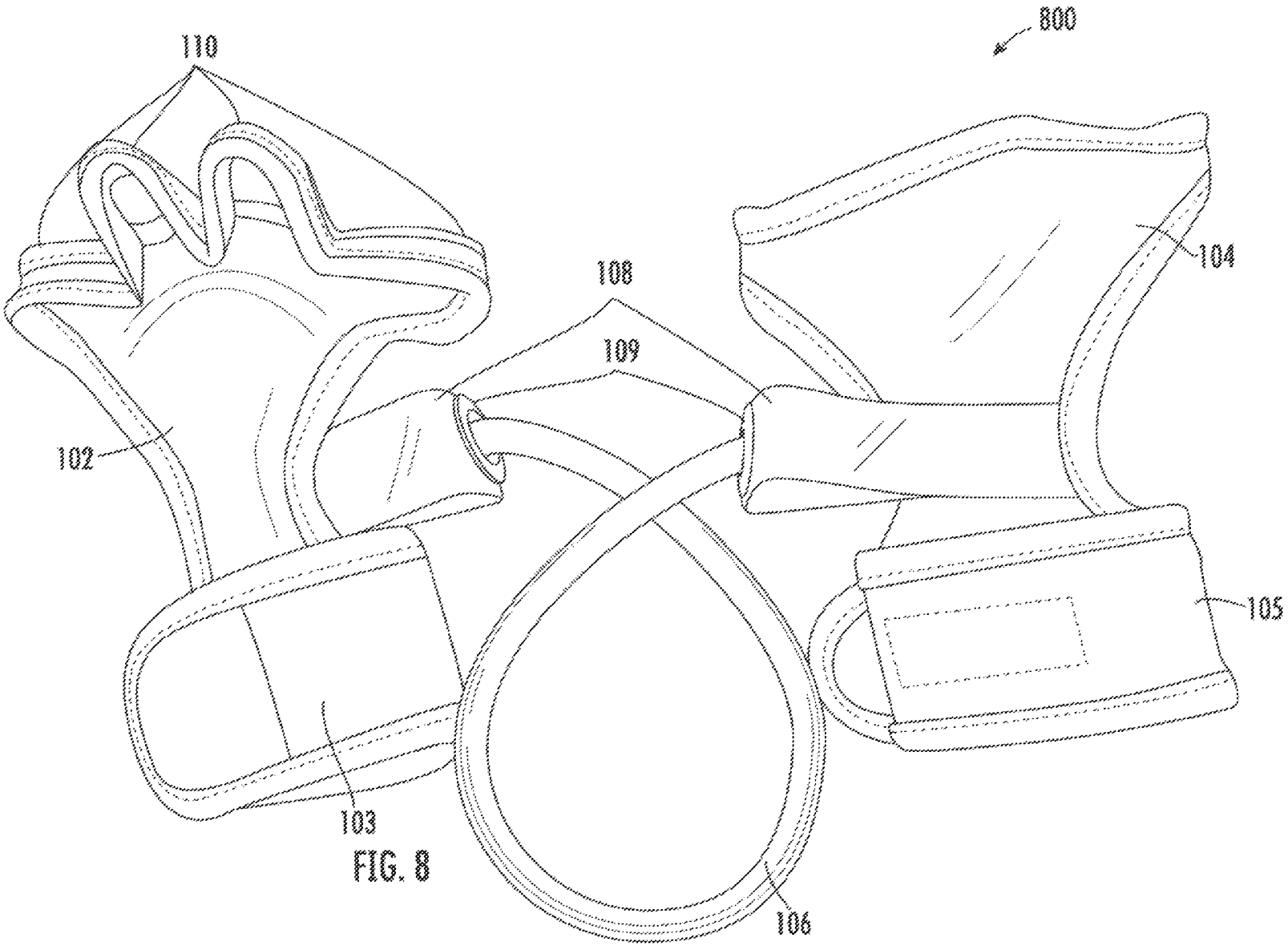

Referring now to FIGS. 7-8, illustrations 700 and 800 show the exercise device 100 with the left-wrist strap 103 and the right-wrist strap 105 in the wrapped position, according to some embodiments. For both the left-wrist strap 103 and the right-wrist strap 105, the fastener 116 is attached to the fastener 112 and the fastener 118 is attached to the fastener 116 (not shown).

Figure 12:
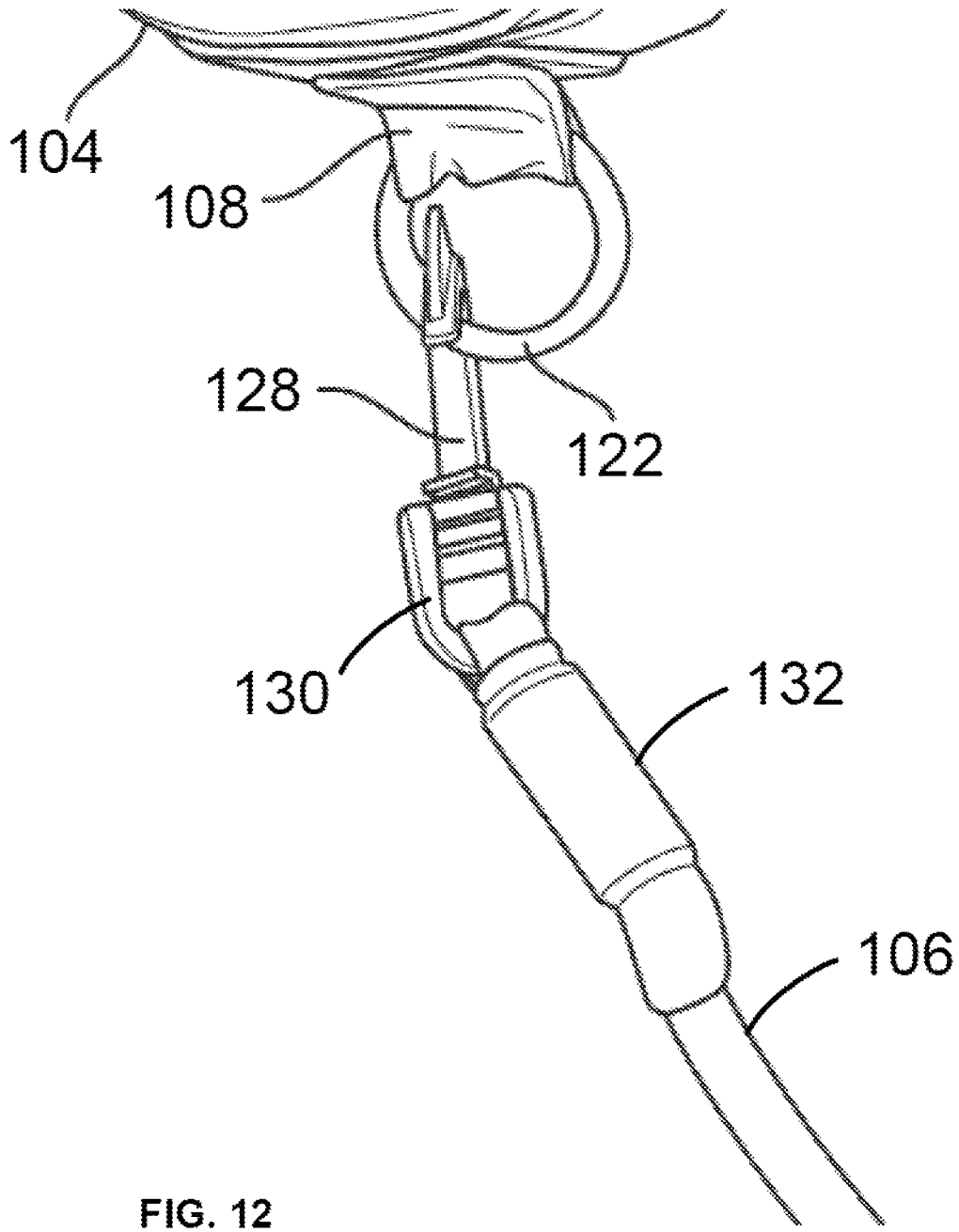
FIG. 12 is an illustration of an additional view of the exercise device of FIG. 1.

Referring to FIG. 12, an additional embodiment of the exercise device 100 is shown. In some embodiments, such as that of FIG. 12, the connectors 108 may be configured to be coupled to a loop 122. The loop 122 may be comprised of a metal, plastic, polymer, or other rigid material and may be at least partially disposed within a portion of the connector 108 as shown. In some embodiments, the loop 122 may be of a pliable material, such as a rubber, silicon, or textile, and may be configured to be manipulated as the user performs various exercises and assume different circular or elliptical shapes. The loop may also be configured to accommodate a clasp 128, as shown in FIG. 12. The clasp 128 is shown to be coupled to an end 130 of the tension member 106. The end 130 of the tension member 106 is configured to couple to at least a portion of the clasp such that the loop 122 and the end 130 of the tension member 106 are indirectly coupled via the clasp. In some embodiments, the tension member 106 includes a reinforcement 132 to reinforce the end 130 of the tension member 106 to provide for a more secure coupling between the tension member 106 and the clasp 128. It should be noted that the coupling mechanism shown in FIG. 12 between the loop 122 and the clasp may have alternate embodiments. For example, the end 130 may be configured to accommodate a first portion of a buckle or other coupling mechanism, with the connector 108 configured to accommodate a second portion of a buckle or other coupling mechanism that is complimentary to the first buckle or coupling mechanism. It should also be noted that one or both of the right-hand glove 104 and the left-hand glove 102 may include loops 122 as shown in FIG. 12 or other similar structures.

The coupling facilitated by the loop 122 and the clasp 128, as shown in FIG. 12, allows for a user to interchange and use multiple tension members 106 the same as and/or similar to that of the tension member 106. For example, as a user performs exercises using the exercise device 100, the tension member 106 may become easier to stretch, and the user may also gain strength and desire to use a tension member with greater resistance than that offered by the tension member 106. For example, a user may use the tension member 106 (e.g., a tension member rated to have 10 lbs of resistance) as shown in FIG. 12 for various exercises, and as a result of performing the various exercises repeatedly, gain strength and desire a tension member similar to the tension member 106 that offers greater resistance (e.g., a tension member rated to have 20 lbs of resistance). The clasp 128 and the loop 122 as shown in FIG. 12 allow for the user to decouple the first tension member 106, and couple a second tension member 106 having a clasp 128 for connecting the second tension member 106 to the loop 122, thus allowing the user to perform exercises with greater resistance. In another example, a user may desire to use the exercise device 100 to perform warmup exercises prior to beginning other exercises. Accordingly, the user may desire to use a tension member similar to the tension member 106 having a lower resistance rating (e.g., 5 lbs of resistance).

The clasp 128 of the tension member 106 and the loop 122 enable the user to decouple the first tension member 106 and replace it with a second tension member 106 having the same or a similar coupling mechanism for coupling to the loop 122 and a lower resistance, thus enabling the user to perform the desired exercises with lesser resistance. Any number of additional tension members 106 having the same or different resistance as the tension member 106 can be interchanged with the tension member 106 by the user.

Figure 9:
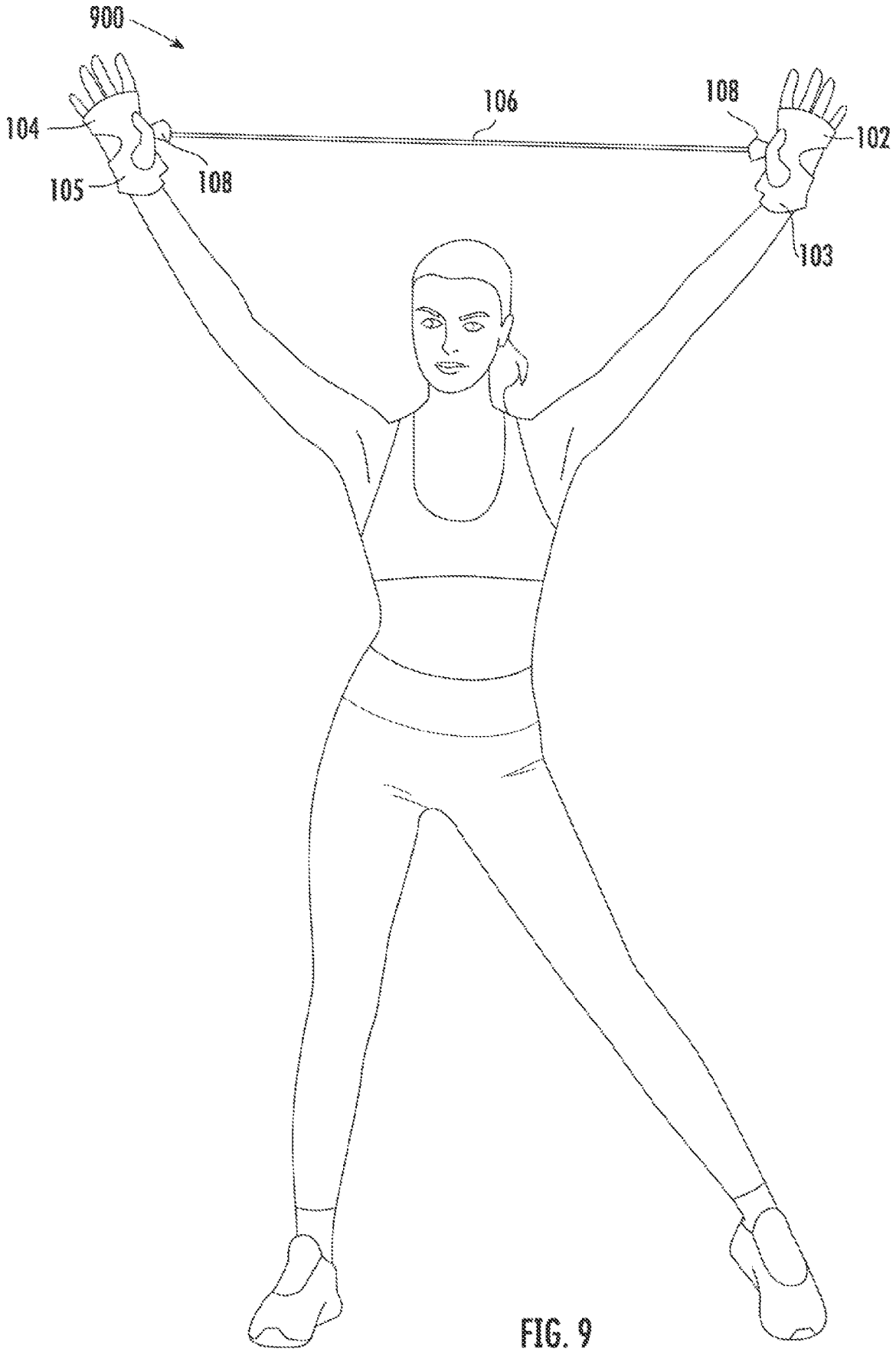
FIGS. 9-11 are illustrations of example exercises that can be performed by a user with the exercise device of FIG. 1, according to exemplary embodiments.
Figure 10:
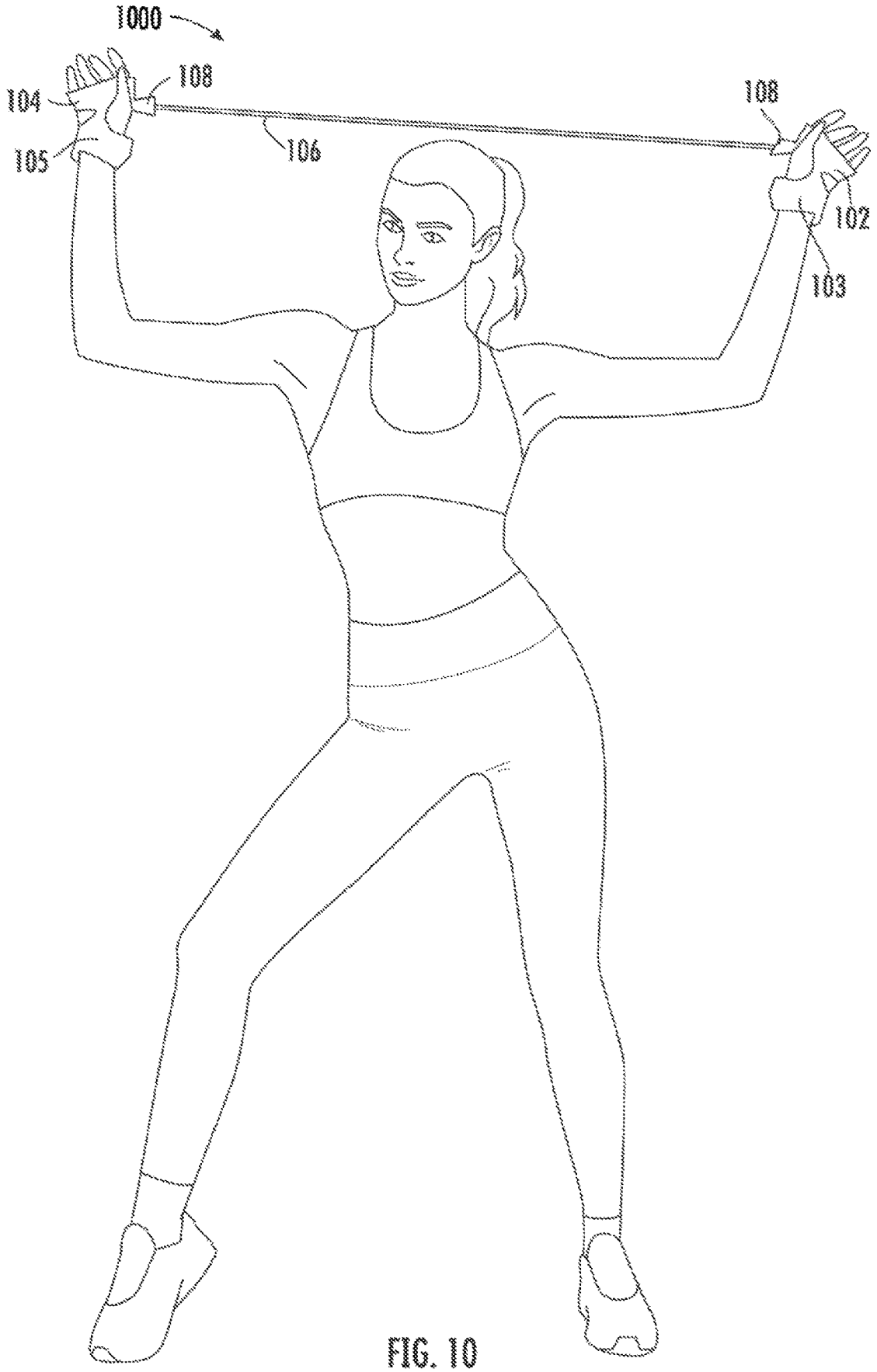
Figure 11:
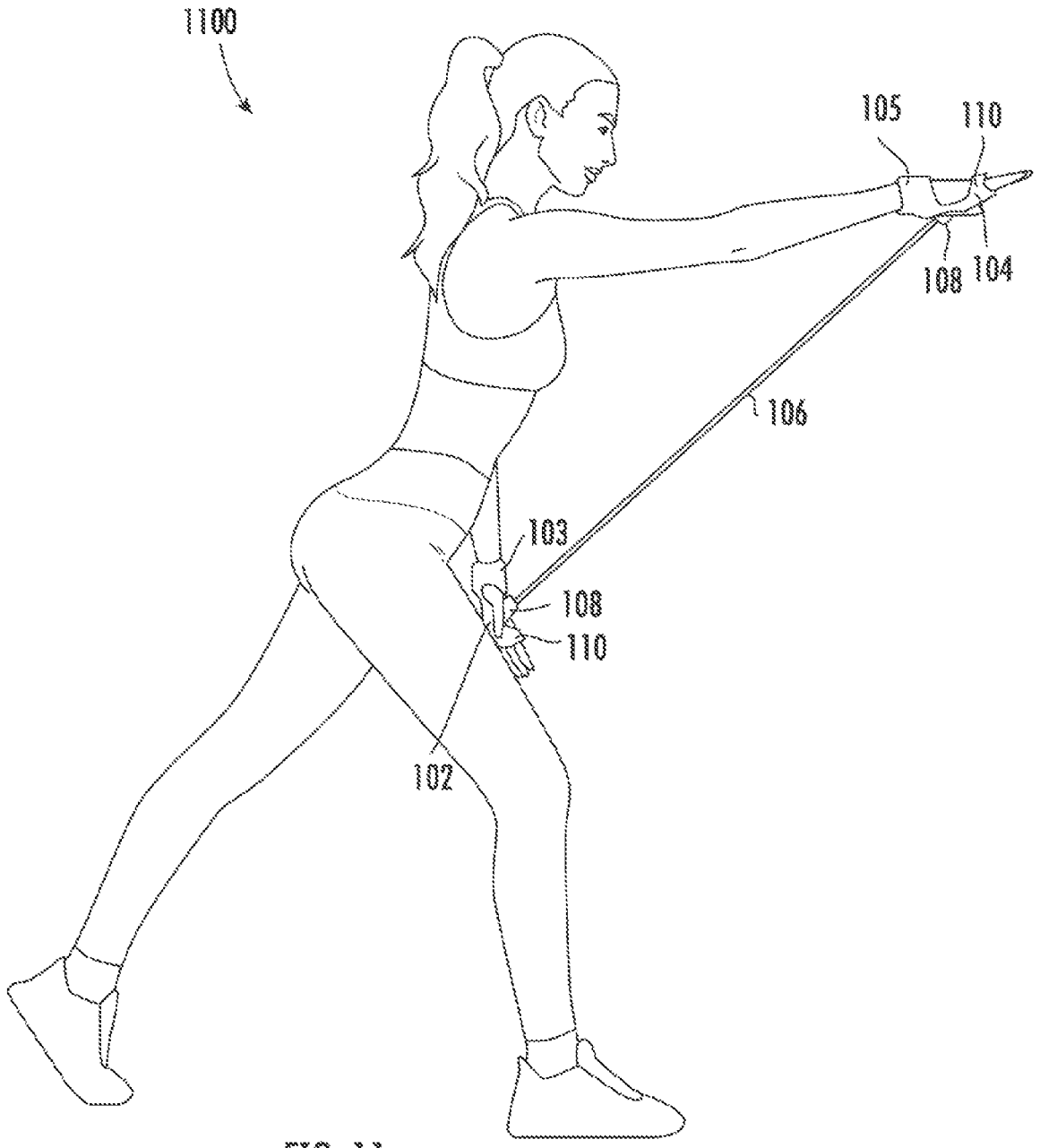

Referring now to FIGS. 9-11, illustrations show exercises 900, 1000, and 1100 that can be performed by the user with the exercise device 100, according to some embodiments. The user is shown wearing the exercise device 100 and performing the exercises 900, 1000, and 1100. The exercises 900, 1000, and 1100 are shown as examples only for descriptive purposes and should not be seen as limiting. The user can perform any appropriate exercise with the exercise device 100 that utilizes resistance training techniques.

Exercise 900 can be performed by a user by lifting his or her arms above his or her head and pulling the tension member 106 taut. The user may then pull one arm down to the side while keeping the other arm in place. The tension member 106 imposes tensile forces between the hands of the user. This exercise may be repeated any number of times, and the function each arm performs may be switched to the other arm.

Exercise 1000 can be performed by a user by bending his or her arms at the elbow to a 90-degree angle. The user can keep one arm steady and pull down the other arm, keeping the arms bent at the 90-degree angle. The user may slowly pull until he or she starts to feel resistance in the tension member 106. This exercise may be repeated any number of times, and the function each arm performs may be switched to the other arm.

Exercise 1100 can be performed by a user by placing one foot behind the other foot and tilting forward with his or her back kept straight. The user can extend both arms straight ahead at shoulder-level. If the user places his or her left foot behind the right foot, the user may pull his or her left arm down towards his or her thigh, while the right arm stays completely still. The tension member 106 imposes tensile forces between the hands of the user. This exercise may be repeated any number of times, and the function each arm or leg performs may be switched to the other arm or leg.

As utilized herein, the terms "approximately," "about," "substantially", and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the disclosure as recited in the appended claims.

It should be noted that the term "exemplary" and variations thereof, as used herein to describe various embodiments, are intended to indicate that such embodiments are possible examples, representations, or illustrations of possible embodiments (and such terms are not intended to connote that such embodiments are necessarily extraordinary or superlative examples).

The term "coupled" and variations thereof, as used herein, means the joining of two members directly or indirectly to one another. Such joining may be stationary (e.g., permanent or fixed) or moveable (e.g., removable or releasable). Such joining may be achieved with the two members coupled directly to each other, with the two members coupled to each other using a separate intervening member and any additional intermediate members coupled with one another, or with the two members coupled to each other using an intervening member that is integrally formed as a single unitary body with one of the two members. If "coupled" or variations thereof are modified by an additional term (e.g., directly coupled), the generic definition of "coupled" provided above is modified by the plain language meaning of the additional term (e.g., "directly coupled" means the joining of two members without any separate intervening member), resulting in a narrower definition than the generic definition of "coupled" provided above. Such coupling may be mechanical, electrical, or fluidic.

The term "or," as used herein, is used in its inclusive sense (and not in its exclusive sense) so that when used to connect a list of elements, the term "or" means one, some, or all of the elements in the list. Conjunctive language such as the phrase "at least one of X, Y, and Z," unless specifically stated otherwise, is understood to convey that an element may be either X, Y, Z; X and Y; X and Z; Y and Z; or X, Y, and Z (i.e., any combination of X, Y, and Z). Thus, such conjunctive language is not generally intended to imply that certain embodiments require at least one of X, at least one of Y, and at least one of Z to each be present, unless otherwise indicated.

References herein to the positions of elements (e.g., "top," "bottom," "above," "below") are merely used to describe the orientation of various elements in the FIGURES. It should be noted that the orientation of various elements may differ according to other exemplary embodiments, and that such variations are intended to be encompassed by the present disclosure.

Although the figures and description may illustrate a specific order of method steps, the order of such steps may differ from what is depicted and described, unless specified differently above. Also, two or more steps may be performed concurrently or with partial concurrence, unless specified differently above.

What is claimed is:

1. An exercise device comprising:

a first set of one or more finger loops coupled to a first palm portion having a first surface and a second surface opposite the first surface, the first set of one or more finger loops configured to be worn on a first hand of a user such that the first surface of the first palm portion interfaces with a palm of the first hand;

a second set of one or more finger loops coupled to a second palm portion having a first surface and a second surface opposite the first surface, the second set of one or more finger loops configured to be worn on a second hand of the user such that the first surface of the second palm portion interfaces with a palm of the second hand; and a first connector coupled to and located on the second surface of the first palm portion and a second connector coupled to and located on the second surface of the second palm portion, the first connector and the second connector secured to opposite ends of a tension member linking the first palm portion and the second palm portion;

wherein the first connector is located only on the second surface of the first palm portion.

2. The exercise device of claim 1, wherein the connectors are looped structures.

3. The exercise device of claim 2, wherein the connectors include at least one of a nylon material or a fabric material.

4. The exercise device of claim 1, wherein the connectors each comprise a grommet configured to reinforce a portion of the connector that interfaces with the tension member.

5. The exercise device of claim 4, wherein the grommets include at least one of a metal material or a plastic material.

6. The exercise device of claim 1, wherein the connectors are configured to rotate or twist about the second surfaces of the palm portions.

7. The exercise device of claim 1, wherein each connector is configured to move laterally to enable at least a portion of the connector to lay flat against the second surfaces of its corresponding palm portion.

8. The exercise device of claim 1, wherein the tension member comprises two retaining balls, wherein each retaining ball has a diameter greater than an inner diameter of an interface of the connectors and the tension member, the retaining balls located on opposite ends of the tension member and configured to prevent the tension member from disengaging with the connectors.

9. The exercise device of claim 1, wherein the tension member has a tensile force in the range of 6 pounds to 10 pounds when pulled to a length that is 2.5 times longer than a relaxed length of the tension member.

10. The exercise device of claim 1, wherein the tension member has a relaxed length between 10 inches and 18 inches between the opposite ends of the tension member.

11. The exercise device of claim 1, wherein the tension member is releasably coupled to the connectors such that the tension member is interchangeable with another tension member.

12. The exercise device of claim 1, wherein each of the first palm portion and the second palm portion further comprise a respective wrist wrap configured to secure the respective palm portions to respective hands of the user.

13. An exercise device comprising:

a first set of one or more finger loops coupled to a first palm portion having a first surface and a second surface opposite the first surface, the first set of one or more finger loops configured to be worn on a first hand of a user such that the first surface of the first palm portion interfaces with a palm of the first hand;

a second set of one or more finger loops coupled to a second palm portion having a first surface and a second surface opposite the first surface, the second set of one or more finger loops configured to be worn on a second hand of the user such that the first surface of the second palm portion interfaces with a palm of the second hand; and a first connector coupled to and located on the second surface of the first palm portion and a second connector coupled to and located on the second surface of the second palm portion, each of the connectors secured to opposite ends of a tension member linking the first palm portion and the second palm portion, each of the connectors comprising:

a looped structure; and a grommet configured to reinforce a portion of the connector that interfaces with the tension member; and wherein the first connector is located only on the second surface of the first palm portion.

14. The exercise device of claim 13, wherein the connectors are configured to rotate freely about the second surfaces of the palm portions.

15. The exercise device of claim 13, wherein each connector is configured to move laterally to enable at least a portion of the connector to lay flat against the second surface of its corresponding palm portion.

16. The exercise device of claim 13, wherein the tension member comprises two retaining balls where each retaining ball has a diameter greater than an inner diameter of an interface of the connectors and the tension member, the retaining balls located on opposite ends of the tension member and configured to prevent the tension member from disengaging with the connectors.

17. The exercise device of claim 13, wherein the tension member is configured to have a tensile force of up to 8 pounds when the user pulls the tension member to a length that is 2.5 times longer than a relaxed length of the tension member.

18. The exercise device of claim 13, wherein the tension member is configured to have a relaxed length between 10 inches and 18 inches between the opposite ends of the tension member.

19. An exercise device comprising:

a first set of one or more finger loops coupled to a first palm portion having a first surface and a second surface opposite the first surface, the first set of one or more finger loops configured to be worn on a first hand of a user such that the first surface of the first palm portion interfaces with a palm of the first hand;

a second set of one or more finger loops coupled to a second palm portion having a first surface and a second surface opposite the first surface, the second set of one or more finger loops configured to be worn on a second hand of the user such that the first surface of the second palm portion interfaces with a palm of the second hand; and a first connector coupled to and located on the second surface of the first palm portion and a second connector coupled to and located on the second surface of the second palm portion, a looped structure that is configured to releasably couple with a tension member such that the tension member is interchangeable with another tension member, each of the connectors configured to:

rotate about the second surfaces of the palm portions; and move laterally to enable at least a portion of the connector to lay flat against the second surface of its corresponding palm portion; and wherein the first connector is located only on the second surface of the first palm portion.

20. The exercise device of claim 19, wherein each end of the tension member comprises a buckle or clasp configured to releasably couple with the connectors.

* * * * *